United States Patent [19]

Smoczynski

[11] 4,077,145

[45] Mar. 7, 1978

[54] NUMBER PLATES FOR RACING VEHICLES

[76] Inventor: Frank E. Smoczynski, 101 E. Oak-Glen Dr., Bartlett, Ill. 60103

[21] Appl. No.: 733,084

[22] Filed: Oct. 18, 1976

Related U.S. Application Data

[63] Continuation-in-part of Ser. No. 568,459, Apr. 16, 1975, abandoned.

[51] Int. Cl.[2] ..... G09F 21/04

[52] U.S. Cl. ..... 40/590; 40/615; 40/200; 40/591

[58] Field of Search ..... 40/129 C, 135, 200, 40/2.2, 136, 154; 280/152.1, 152.2, 152.3, 154.5 A, 153 A; 428/31; 427/258; D12/114, 186; D96/12 E

[56] References Cited

U.S. PATENT DOCUMENTS

| | | | |
|---|---|---|---|
| 3,163,554 | 12/1964 | Gussler | 40/135 |
| 3,338,395 | 8/1966 | Silverstein | 40/125 A |
| 3,468,744 | 9/1969 | Reinhart | 40/136 |
| 3,725,184 | 4/1973 | Scopp | 40/2.2 X |
| 3,871,119 | 3/1975 | Mayer | 260/75 T X |
| 3,921,323 | 11/1975 | Petty | 40/129 C X |

FOREIGN PATENT DOCUMENTS

| | | | |
|---|---|---|---|
| 639,097 | 3/1962 | Canada | 40/615 |
| 2,233,061 | 3/1974 | Germany | 40/136 |
| 1,205,043 | 9/1970 | United Kingdom | 40/125 A |

OTHER PUBLICATIONS

"Trickray" Ad, American Bicyclist & Motorcyclist, 3-1974, p. 17.

"Victor Plastics" Ad, Motorcycle Industry, 9-1974, p. 33.

*Primary Examiner*—Jay N. Eskovitz
*Assistant Examiner*—John J. Wilson
*Attorney, Agent, or Firm*—Joseph P. Gastel

[57] ABSTRACT

Each of a set of three flexible number plates for racing motor-bicycles consists of a base material, such as polyvinyl chloride of approximately 20 mil thickness, with a first color applied or sheet laminated to one side of the base material and a second color applied or sheet laminated to the opposite side of the base material. Imprinting or identifying logos are applied to the color material on both sides of the plate and then an overlaminate material, such as 5 mil clear plastic, is applied over both sides of the base, color material and imprinting. Then the actual identifying numbers are applied to the overlaminate on both sides of the plate.

19 Claims, 7 Drawing Figures

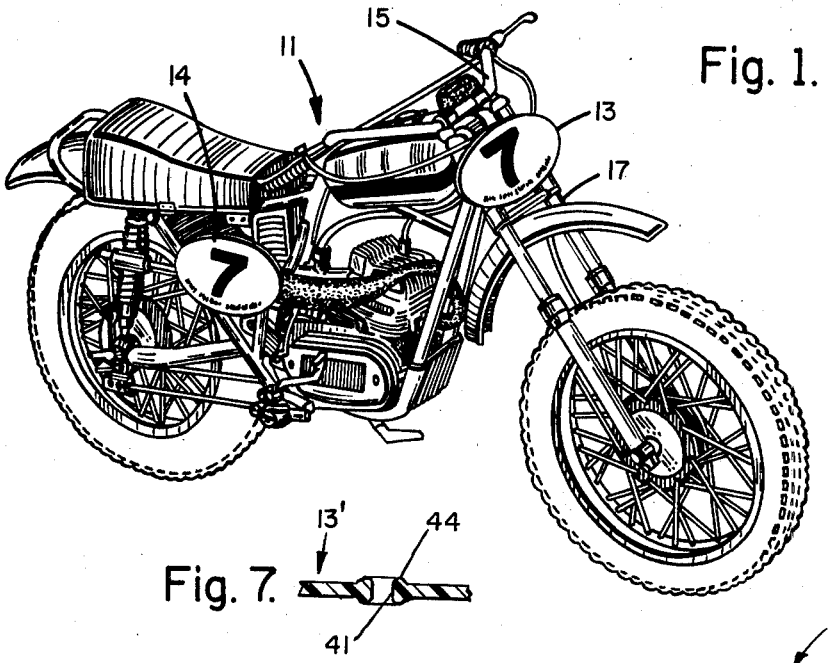
Fig. 1.
Fig. 7.
Fig. 2.
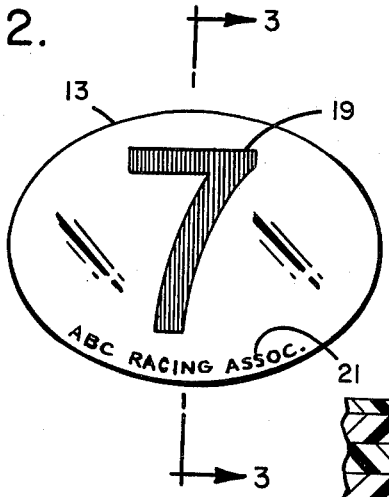
Fig. 6.
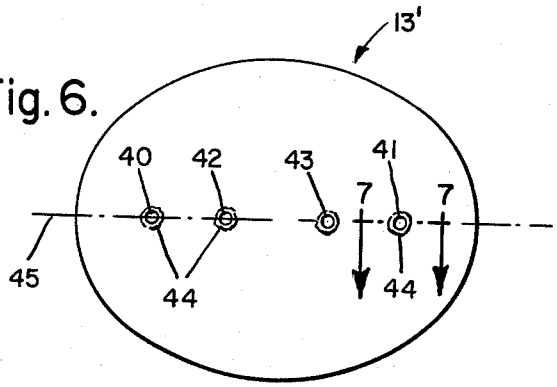
Fig. 4.
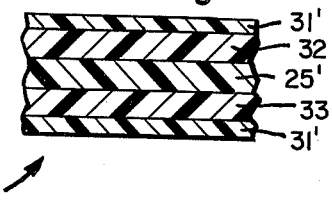
Fig. 5.
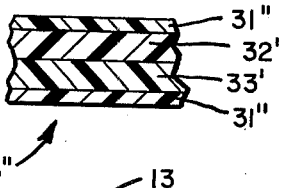
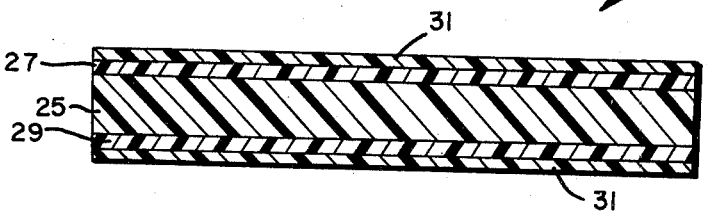
Fig. 3.

NUMBER PLATES FOR RACING VEHICLES

The present invention is a continuation-in-part of copending application Ser. No. 568,459, filed Apr. 16, 1975 and now abandoned.

This invention relates generally to number plates for racing vehicles and more particularly to improved colored number plates, such as used with racing motorbicyles to identify the bicycle and its class.

In the racing of motor-bicycles, a number plate is used to identify the individual riders by number, and in addition the color of the plate is used to denote the class or cubic centimeter (hereinafter referred to as cc) displacement of the motor bike. For example, in the 125 cc Class, the number plates are red with white numbers. In the 250 cc Class, the number plates are solid green with white numbers, and for the Open Class, the number plates are yellow with black numbers. For the professional cass, a white plate with black numbers is used.

For each racing vehicle, three number plates are required. One is mounted on the front of the motorbicycle and one each are mounted on the sides of the motor-bicycle. The present number plates are generally plastic and made by injection molding. These plates may weigh as much as 8 to 10 ounces each and, of course, there is only one color per plate. Furthermore, because of the lubricants used in the injection molding processes, the number adhesion to the present number plates is very poor, and also the color of the plates is somewhat dull tending toward pastels, rather than rich, vibrant colors.

Therefore, if a racer is participating in a number of different classes, he must have an equivalent number of sets of plates of the appropriate color for each of the classes in which he participates. Further, since the number adhesion to the prior art number plates is very poor, the cost of replacing the numbers as they fall off the plate can be significant. Also, as the participant is involved in the race, dust, dirt, etc. tend to further reduce the visibility of the relatively dull number plates, making identification of the individual participants very difficult for the judges of the race.

Therefore, it is a principal object of the present invention to provide improved number plates for the identification of racing motor-bicycles which overcome the foregoing disadvantages of prior art devices.

Another object of the invention is to provide improved number plates for racing motor-bicycles of economic design and increased flexibility.

Another object of the invention is to provide improved number plates for racing motor-bicycles that are light in weight.

Yet another object of the invention is to provide improved number plates for racing motor-bicycles having rich, vibrant color characteristics.

Still another object of the present invention is to provide improved number plates for racing motor-bicycles having improved adhesion characteristics facilitating the use of stick-on numbers for identification purposes.

The present invention relates to a number plate for racing two-wheeled vehicles comprising base material means having first and second sides, first color means on said first side, second color means on said second side, and overlaminate material means applied to said first and second sides for providing a protective sealing surface for said first and second color material means and for providing surfaces to which identifying numbers can be positively secured by adhesion, said overlaminate material means being transparent to permit viewing of said first and second color means therethrough. Preferably the number plate is extremely flexible to provide relatively low wind resistance when mounted on the front of the motor-bicycle.

According to one aspect of the invention a number plate consists of a base material, such as high impact polyvinyl chloride of approximately 20 mil thickness, with a first color silk screened on one side of the base material and a second color silk screened on the other side of the base material. The imprinting or identifying material with respect to manufacturer, model, racing association, etc. may then be printed on the colored material of each side using any one of the number of acceptable printing techniques. Next, an overlaminating material, such as 5 mil clear plastic, high impact polyvinyl chloride, is applied to both sides of the base and is run through a laminating process resulting in a unitary sheet of material having different colors on each side of the material. After this, the material is cut into the desired shape and is then ready to have the identifying numbers applied thereto.

As an alternate to the above, rather than using a twenty mil base plate, and then silk screening the colors on either side thereof, two colored 10 mil sheets of material, such as polyvinyl chloride, can simply be laminated together, following which the procedure for printing and overlaminating would remain the same.

As another alternative, two colored 10 mil sheets of material, such as polyvinyl chloride, can be laminated to the opposite sides of a base material, such as high impact polyvinyl chloride, following which the procedure for printing and overlaminating would remain the same.

FIG. 1 is a pictorial representation of a motor-bicycle having identifying number plates attached thereto;

FIG. 2 is an enlarged frontal view of an identifying number plate as used in motor-bicycle racing;

FIG. 3 is a cross sectional view of the identifying number plate of FIG. 2 taken along lines 3—3;

FIG. 4 is a fragmentary cross sectional view similar to FIG. 3 of a modified form of identifying number plate;

FIG. 5 is a fragmentary cross sectional view similar to FIG. 3 of a still further modified form of identifying number plate;

FIG. 6 is a view of a number plate having holes therein for receiving mounting ties; and FIG. 7 is a fragmentary cross sectional view taken substantially along line 7—7 of FIG. 6.

For a better understanding of the present invention, together with other and further objects and advantages thereof, reference is made to the following description in conjunction with the above described drawings.

Referring first to FIG. 1, the motor-bicycle 11 has the identifying number plate 13 mounted below the handle bars 15 on the front wheel support 17. Second and third number plates 14 of identical design and color are mounted below the seat on both sides of the bike 11. As can be seen more clearly in FIG. 2, each plate includes an identifying number 19 and may include further identifying information 21, such as the racer's affiliation, or a manufacturer's designation. The same identifying information is found on the opposite side of the plate, but the opposite side of the plate will be a different color.

Referring next to FIG. 3, the plate 13 consists of a base material 25, such as polyvinyl chloride or other suitable material having basic sheet strength being, for example, about twenty mil thick. It is to be understood that large numbers of plates can be prepared at one time on a single sheet. Mounted on one side of the center material 25 is a first color material 27, which could be, for example, a two-sided cushioned tape, plastic dye-down or penduit, or could be a silk screened color. On the opposite side of the base material 25 is a second color material 29 similarly applied.

Once the color materials 27 and 29 are suitably applied to the base material 25, using any generally acceptable printing technique, the customers logo, racing association information or other identifying information can be printed on both sides of the material. Next, an overlaminate material 31, such as, for example, five mil clear polyvinyl chloride is placed on both sides of the sheet and laminated thereto. Following this step, the material is cut to the desired configuration, such as the oval shown in FIG. 2 and is ready to have the identifying number 19 applied thereto. Because the polyvinyl chloride has excellent adhesion characteristics, conventional stick-on numbers may be used and will adhere extremely well to the overlaminate material.

In the preferred embodiment, which is illustrated by FIG. 4, the plate 13′ consists of a base material 25′, such as high-impact polyvinyl chloride about 10 mil thick. Different colored sheets 32 and 33 made out of polyvinyl chloride or other suitable material about 10 mils thick, are laminated to opposite sides of base 25′. Next, an overlaminate material 31′, such as 5 mil clear polyvinyl chloride, is placed on sheets 32 and 33 and laminated thereto. A suitable high impact base material 25′ is commercially known under the trademark KRENE.

Referring next to FIG. 5, rather than using a separate base material, the number plate may be constructed by using two sheets of colored material 32′ and 33′, such as polyvinyl chloride, each about 10 mils thick, and laminating them together to provide the initial base of material having different colors on either side thereof. Then, an overlaminate material 31″, about 5 mils thick, and similar to overlaminate material 31, is placed on sheets 32′ and 33′, and laminated thereto.

Using the foregoing techniques, the finished plates weigh only about 1 and 1½ to 2 ounces and have excellent color rendition and visibility and therefore provide a much better contrast between the number and the plate, permitting a racing scorer, for example, to identify the individual racers more readily. Also, of course, each plate is really two plates since there is a different color on each side. Further because of the improved adhesion of the stick-on numbers to the plate, the cost of replacing numbers which fall off during competition is significantly reduced. Because of the resilient nature and relative thinness of the polyvinyl chloride sheet material, the number plates are extremely flexible. In this respect, the flexible nature of the plates allows the plate mounted on the front wheel support to bend when encountering wind forces, thereby reducing its wind resistance. Also, the flexibility of the plates makes them less susceptible to damage if they are bumped by foreign objects.

The number plate 13′ of FIG. 6 includes a plurality of holes therein. Holes 40 and 41 are spaced equidistantly from opposite edges of the plate. Holes 42 and 43 are also spaced equidistantly from opposite side edges of the plate. The spacing between holes 40 and 42 is the same as the spacing between holes 41 and 43. As shown in FIG. 6, all of the holes are located on the horizontal centerline 45 of plate 13′. The holes 41–43 are formed by pushing a heated rod through the plastic sheeting so as to form a fused peripheral portion 44 on the periphery of each of the holes to thereby strength the plate in this area, considering that the fused portions 44 act as grommets. The number plate 13′ is mounted on the front of the vehicle by passing a first tie member through holes 40 and 42 and wrapping it around one of the bars depicted by numberal 17. A spaced portion of plate 13′ is attached to the other bar member 17 by passing a second tie member through holes 41 and 43 and wrapping it around the other bar 17. It will be appreciated that the bars 17 are the front wheel forks, as depicted in FIG. 1. The ties can be any elongated strip of material, such as cloth, metal wire or plastic. Because the holes 41–43 are on the horizontal centerline of the plate, the plate will be held firmly against the bars. However, it will be appreciated that the holes can be placed in other locations.

While the invention has been described above in conjunction with the description of a preferred embodiment and two other embodiments, it will be readily apparent to those skilled in the art that modifications and variations may be made therein without departing from the spirit or scope of the present invention. For example, rather than applying the customer logo, after the colors or color sheets are applied but before applying the overlaminate, it would be possible to just apply this information after the overlaminate has been applied.

It is therefore intended that the present invention not be limited to the specifics of the foregoing description of the various embodiments, but rather is to embrace the full scope of the appended claims.

What is claimed is:

1. A number plate for racing two wheeled vehicles comprising base material means having first and second sides, first color means substantially entirely covering said first side, second color means substantially entirely covering said second side, said second color means being a different color than said first color means, and overlaminate material means applied to said first and second sides for providing a protective sealing surface for said first and second color means and for providing surfaces to which identifying numbers can be positively secured by adhesion, said overlaminate material means being transparent to permit viewing of said first and second color means therethrough, wherein said number plate is flexible to flex appreciably when subjected to wind force to thereby lessen the effect of wind resistance produced by said number plate, wherein said base material means comprises high impact sheet material means, and whereby said number plate is attachable to a two wheeled vehicle with said first side visible to designate a particular racing class and reversible with said second side visible to designate another racing class.

2. A number plate as set forth in claim 1 wherein said first and second color means comprise first and second plastic sheet material means laminated on opposite sides of said high impact sheet material means.

3. A number plate as set forth in claim 2 wherein said overlaminate material means is relatively thin transparent polyvinyl chloride sheet material laminated to said first and second sheet material means.

4. A number plate as set forth in claim 3 wherein said number plate is of a weight less than about 2 ounces.

5. A number plate as set forth in claim 4 wherein said number plate is of about 40 mil thickness.

6. A number plate as set forth in claim 4 including number means adhesively but removably secured to said overlaminate material means by pressure sensitive adhesive.

7. A number plate as set forth in claim 1 wherein said first and second color means comprise different colored paint means.

8. A number plate as set forth in claim 7 wherein said overlaminate material means is relatively thin polyvinyl chloride sheet material laminated to said paint means.

9. A number plate as set forth in claim 8 wherein said number plate is of a weight between about 1 and 2 ounces.

10. A number plate as set forth in claim 1 wherein said base material means and said first and second color means comprise first and second differently colored plastic sheets which are laminated together.

11. A number plate as set forth in claim 10 wherein said overlaminate material means is relatively thin polyvinyl chloride sheet laminated to said first and second differently colored sheets.

12. A number plate as set forth in claim 11 wherein said number plate is of a weight between 1 and 2 ounces.

13. A number plate as set forth in claim 12 including number means adhesively secured to said overlaminate material means in a removable manner by pressure sensitive adhesive.

14. A number plate as set forth in claim 12 wherein said number plate is of approximately 40 mil thickness.

15. A number plate as set forth in claim 1 including number means adhesively secured to said overlaminate material means by pressure sensitive adhesive.

16. A number plate as set forth in claim 1 including spaced holes in said number plate for mounting said plate on said two wheeled vehicles.

17. A number plate as set forth in claim 16 wherein said holes are proximate the horizontal centerline of said number plate.

18. A number plate as set forth in claim 16 including fused peripheries on said holes in the nature of grommets.

19. A number plate as set forth in claim 18 wherein said holes are proximate the horizontal centerline of said number plate.

* * * * *